US005105605A

United States Patent [19]

Marshall et al.

[11] Patent Number: 5,105,605

[45] Date of Patent: Apr. 21, 1992

[54] PRODUCE BAGGER IMPROVEMENT

[75] Inventors: Dale E. Marshall, Haslett, Mich.; Patrick V. Gilliland, Westlake, Ohio; Richard J. Wolthuis, Haslett; Galen K. Brown, Okemos, both of Mich.

[73] Assignees: The United States of America as represented by the Secretary of Agriculture, Washington, D.C.; Michigan State University, East Lansing, Mich.

[21] Appl. No.: 633,886

[22] Filed: Dec. 26, 1990

[51] Int. Cl.[5] ..... B65B 1/06; B65B 39/06; B65B 43/44

[52] U.S. Cl. ..... 53/473; 53/255; 53/572

[58] Field of Search ..... 53/247, 248, 255, 258, 53/469, 473, 570, 571, 572; 141/391; 193/46, 48

[56] References Cited

U.S. PATENT DOCUMENTS

| | | | |
|---|---|---|---|
| 3,021,656 | 2/1962 | De Vries | 53/248 |
| 3,255,570 | 6/1966 | Weimer | 53/258 |
| 3,594,981 | 7/1971 | Pitts . | |
| 3,608,701 | 9/1971 | Dieter | 53/258 X |
| 3,864,894 | 2/1975 | Sheetz et al. . | |
| 3,965,654 | 6/1976 | Reubens et al. | 53/572 |
| 4,177,621 | 12/1979 | Powell . | |
| 4,370,845 | 1/1983 | Perolls et al. | 53/572 |
| 4,509,309 | 4/1985 | Langen et al. | 53/247 X |

FOREIGN PATENT DOCUMENTS

| | | | |
|---|---|---|---|
| 1145991 | 3/1963 | Fed. Rep. of Germany | 53/248 |

*Primary Examiner*—John Sipos
*Assistant Examiner*—Linda B. Johnson
*Attorney, Agent, or Firm*—M. Howard Silverstein; Randall E. Deck; John D. Fado

[57] ABSTRACT

An apparatus for bagging produce or other articles which minimizes the impact received by the articles as they are put into bags. The apparatus includes a bag support which may be positioned at a reduced angle to the horizontal to decrease the height of fall of the produce into the bag, but which also eliminates the problem of the formation of a single layer of the articles in the bag. The bag support may be used in conjunction with other produce bagging devices conventional in the art for automated or semi-automated bagging of produce or other articles.

24 Claims, 7 Drawing Sheets

PRIOR ART

PRODUCE BAGGER IMPROVEMENT

BACKGROUND OF THE INVENTION

1. Field of Invention

This invention relates to an apparatus for the bagging or packaging of produce or other articles susceptible to damage upon impact.

2. Description of the Prior Art

Conventional produce bagging devices subject the produce to bruising and damage as a result of being dumped into bags or other packages. Devices currently in use employ a pan into which the produce is temporarily placed and an inclined bag support onto which the bags are laid, positioned below the pan outlet. By tipping the pan, the produce is effectively dumped into a bag on the support, with produce falling as much as 50 cm into an empty bag. Considerable bruising results in fruits or vegetables when the energy of the falling articles is absorbed on impact with hard surfaces or other articles already in the bag.

In an attempt to alleviate this problem, bagger improvements have been made to limit damage by reducing the angle of the bag support to the horizontal, decreasing the height of drop of the produce and thus the energy dissipated. However, at this reduced angle, objects tend to roll into the bag in a single layer rather than multiple layers, not completely filling the bag (FIG. 1). Further, objects near the top of the bag are subject to loss or destruction as the bag passes through automated bag closing devices.

SUMMARY OF THE INVENTION

We have now invented an apparatus for bagging produce or other articles susceptible to damage upon impact. The apparatus includes an improved bag support onto which the bags are placed for receiving the produce. The produce or articles are dispensed into an open bag on the support by a produce or article supply assembly, while a bag opening device opens a single bag and holds the same in an open position on the support. Once a bag is filled, a bag transfer assembly transports the filled bag from the support to a bag closing assembly.

The primary object of the invention is to provide an apparatus for bagging produce or other articles which minimizes the impact received by the articles as they are put into bags. The apparatus includes a bag support which may be positioned at a reduced angle to the horizontal to decrease the height of fall of the produce into the bag, but which also eliminates the problem of the formation of a single layer of the articles in the bag.

Another object of this invention is to provide an improved bag support which may be used in conjunction with other produce bagging devices conventional in the art for automated or semi-automated bagging of produce or other articles susceptible to damage upon impact.

Other objectives and advantages of the invention will become readily apparent from the ensuing description.

DETAILED DESCRIPTION OF THE INVENTION

In accordance with this invention we have designed an apparatus for the automated or semi-automated bagging of produce or other articles susceptible to damage upon impact. While not being limited thereto, the device is especially suited to bagging fruits and vegetables, such as apples, onions, oranges, peaches, peppers, etc.

Figure 1:
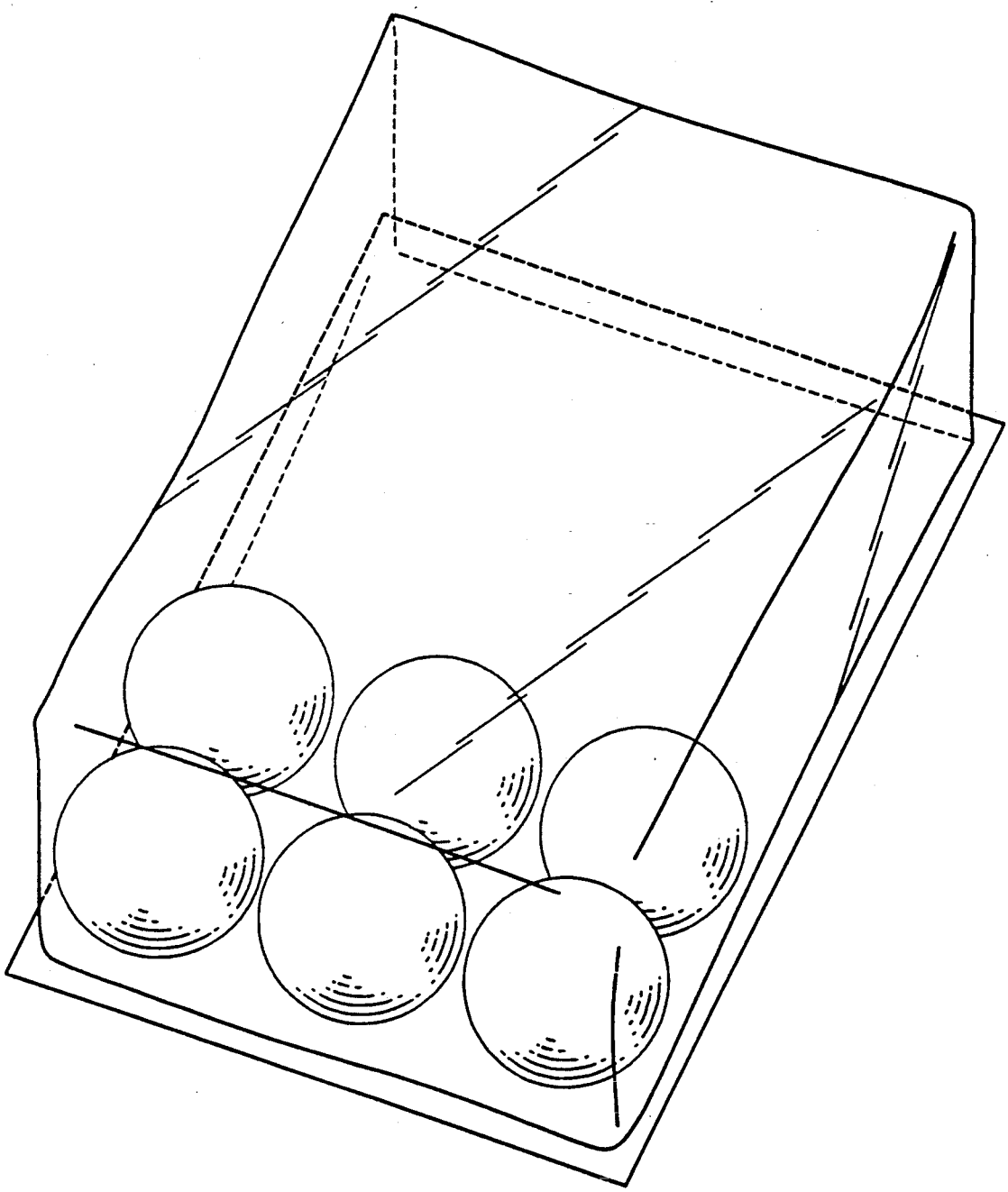
FIG. 1 is a perspective view of a bag support of the prior art, showing produce in a single layer in the bag.
Figure 2:
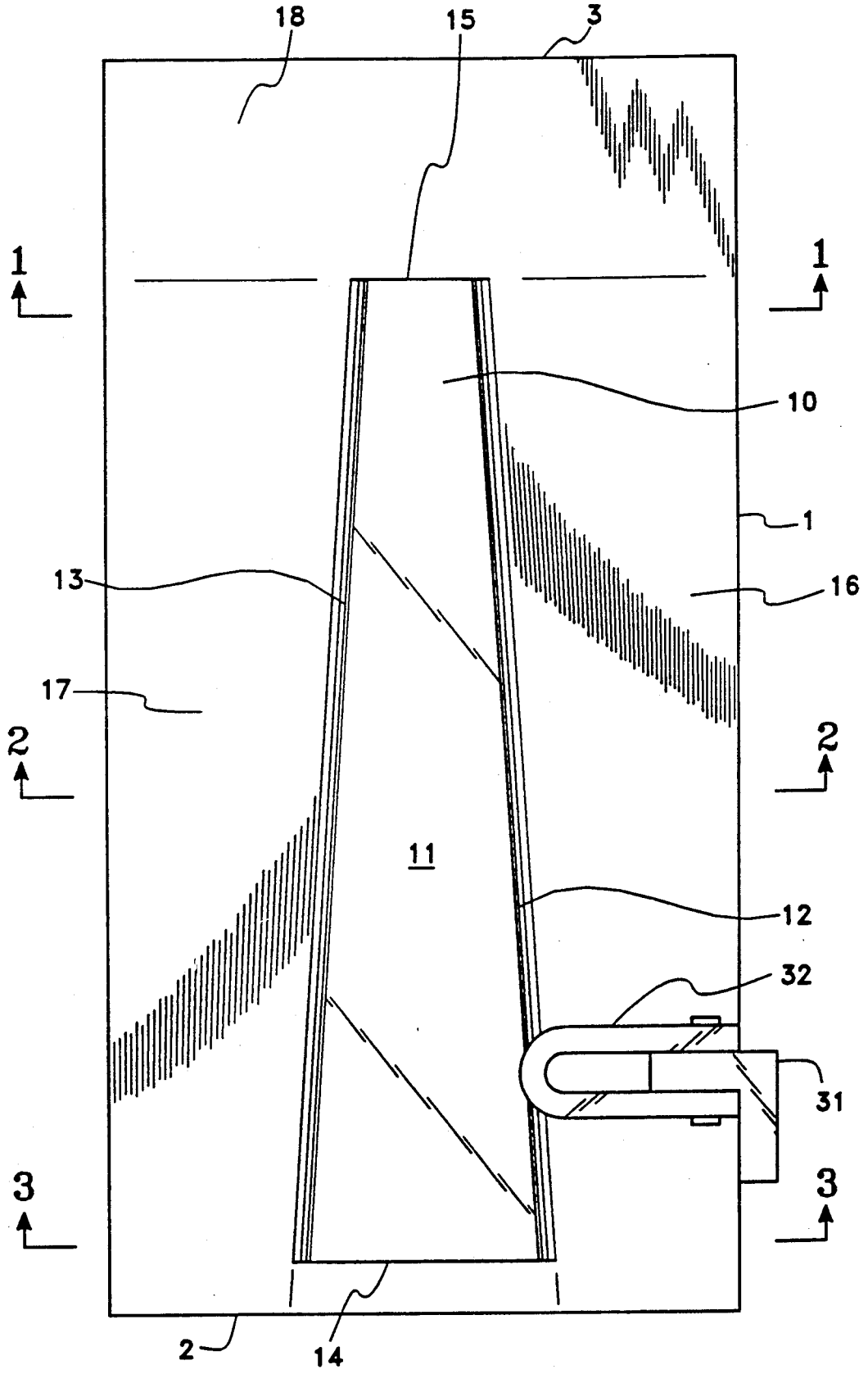
FIG. 2 is a top view of the bag support of the invention.
Figure 3A:
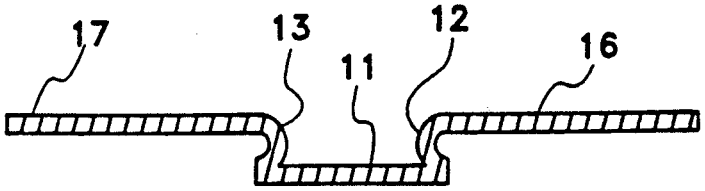
FIGS. 3*a*, 3*b*, and 3*c* are cross-sections of the bag support taken along lines 1—1, 2—2, and 3—3 of FIG. 2, respectively.
Figure 3B:
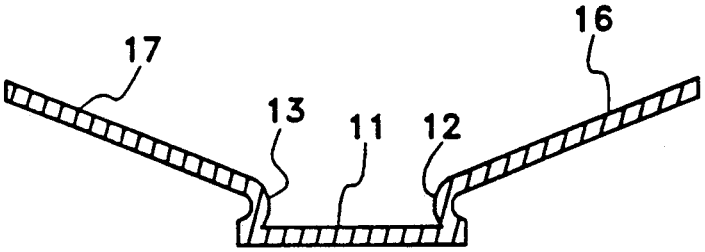
Figure 3C:
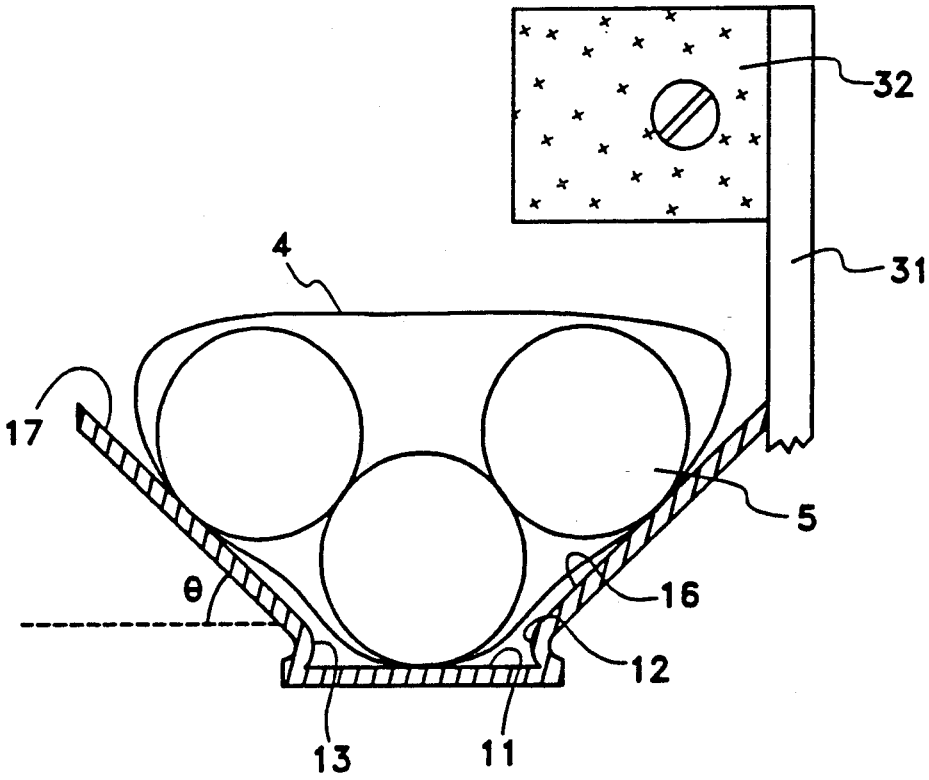
Figure 4:
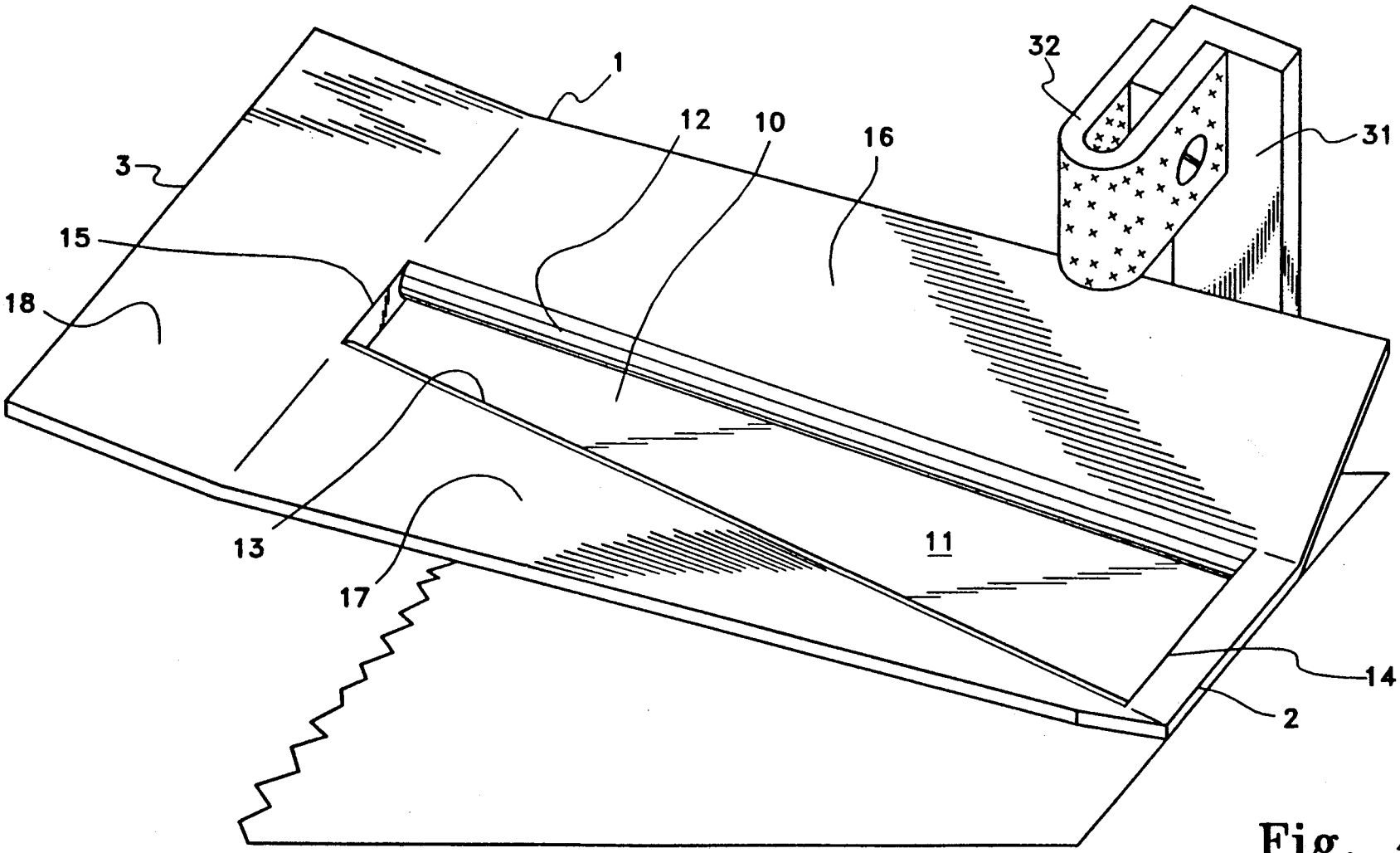
FIG. 4 is a perspective view of the bag support of FIG. 2.

Referring now to FIGS. 2, 3, and 4, the apparatus includes a bag support 1 having a front end 2 and a rear end 3, and onto which bags 4 are placed for receiving the produce 5 (FIG. 3). The open ends of the bags are secured at the rear end 3 of the support. The bag support is constructed as a trough or long, narrow receptacle 10 having a bottom surface 11 and at least two opposed walls 12, 13 extending upwardly therefrom. Each of the opposed walls extend between the front and rear edges 14, 15 of the bottom surface. The support also includes second surfaces 16, 17 connected to and extending outwardly from the upper edge of each of the opposed walls 12, 13, and also extending at least between the front and the rear edges 14, 15. At least a portion of each of the second surfaces 16, 17 is upwardly inclined away from the walls 12, 13, and the angle of inclination $\theta$ decreases from a maximum adjacent said front edge 14 or front end 2 to a minimum adjacent said rear end 3 or rear edge 15 as clearly shown in FIGS. 3*a*, *b*, and *c*.

The size of the components of the support, including the width of the second surfaces normal to the walls, and especially the angle of inclination of the second surfaces, the width of the trough between the opposed walls and the height of the walls (trough depth), are selected to facilitate complete filling of bags thereon. Particularly, the trough and the second inclined surfaces are adapted or constructed of a size effective to prevent articles dispensed into bags on the support from forming only a single layer, and promote settling of the articles into the bag in multiple layers. For example, while not wishing to be limited thereto, a support useful in the bagging of apples has a trough depth of about 2–3 cm, a trough width tapering from about 7–8 cm at the front edge to about 5 cm at the rear edge, an overall support width between the outside edges of the second surfaces at the rear edge of about 25 cm, and an inclination of the outside edges of the second surfaces of about 6–10 cm above the bottom surface of the trough. The practitioner skilled in the art will recognize that this size will vary with the size and shape of the produce or articles to be packaged. The length of the trough between the front and rear edges is not critical, and may be selected in accordance with the size of the bags and the volume of produce in each bag.

The shape of the support is also variable, and the support may be either asymmetric or symmetric about a vertical plane through the center of the trough 10 from the front to the rear edge. Similarly, the width of the trough may be constant, or alternatively tapered toward either edge 14 or 15, and the depth thereof may also vary. The support may further include a third surface 18 at the rear end 3 of the support, extending outwardly from the trough and integral with the second surfaces 16, 17. In this alternative, the second surfaces extend beyond the rear edge 15, which are joined by the third surface 18.

Figure 5:
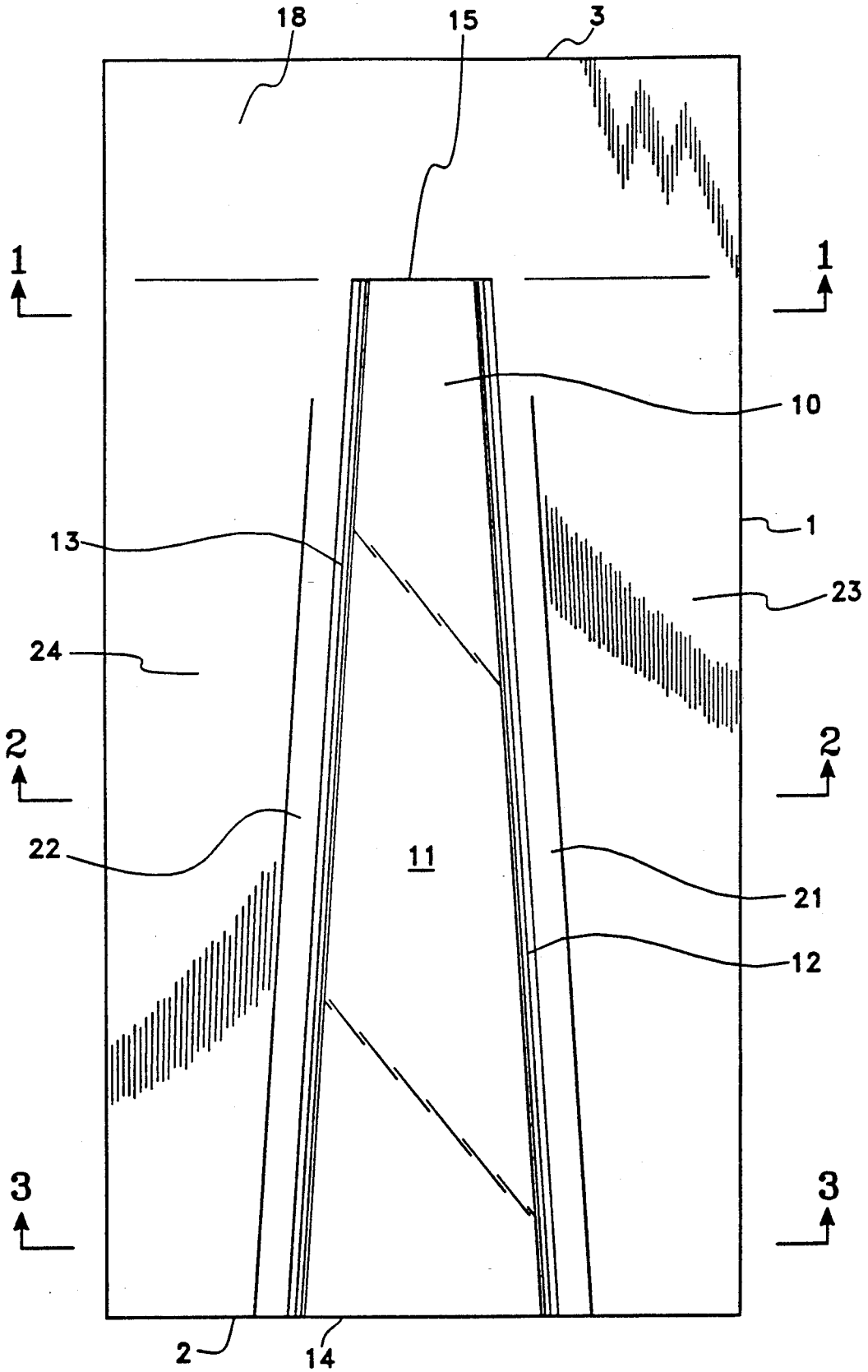
FIG. 5 is a top view of an alternative embodiment of the bag support of this invention.
Figure 6A:
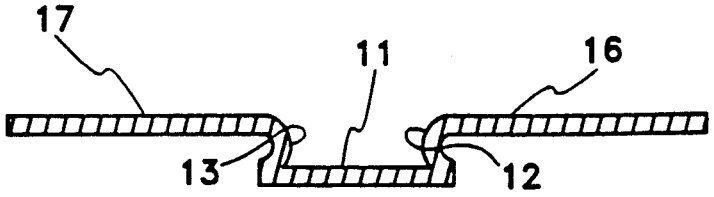
FIGS. 6*a*, 6*b*, and 6*c* are cross-sections of the bag support taken along lines 1—1, 2—2, and 3—3 of FIG. 5, respectively.
Figure 6B:
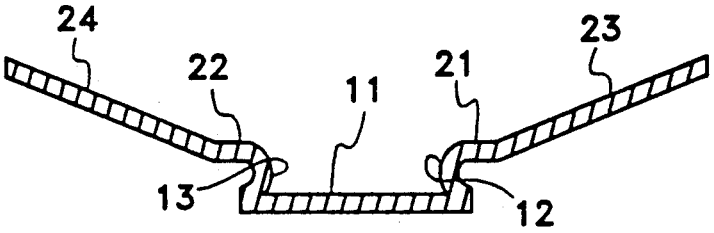
Figure 6C:
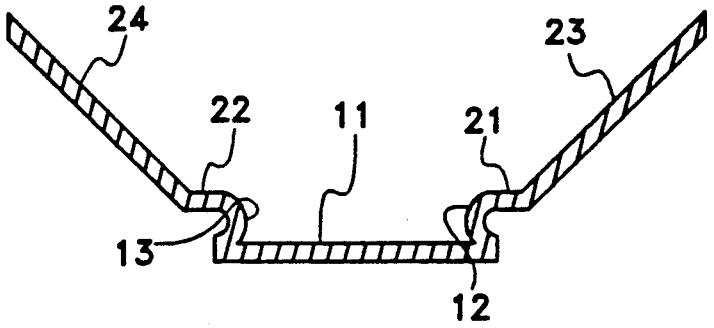
Figure 7:
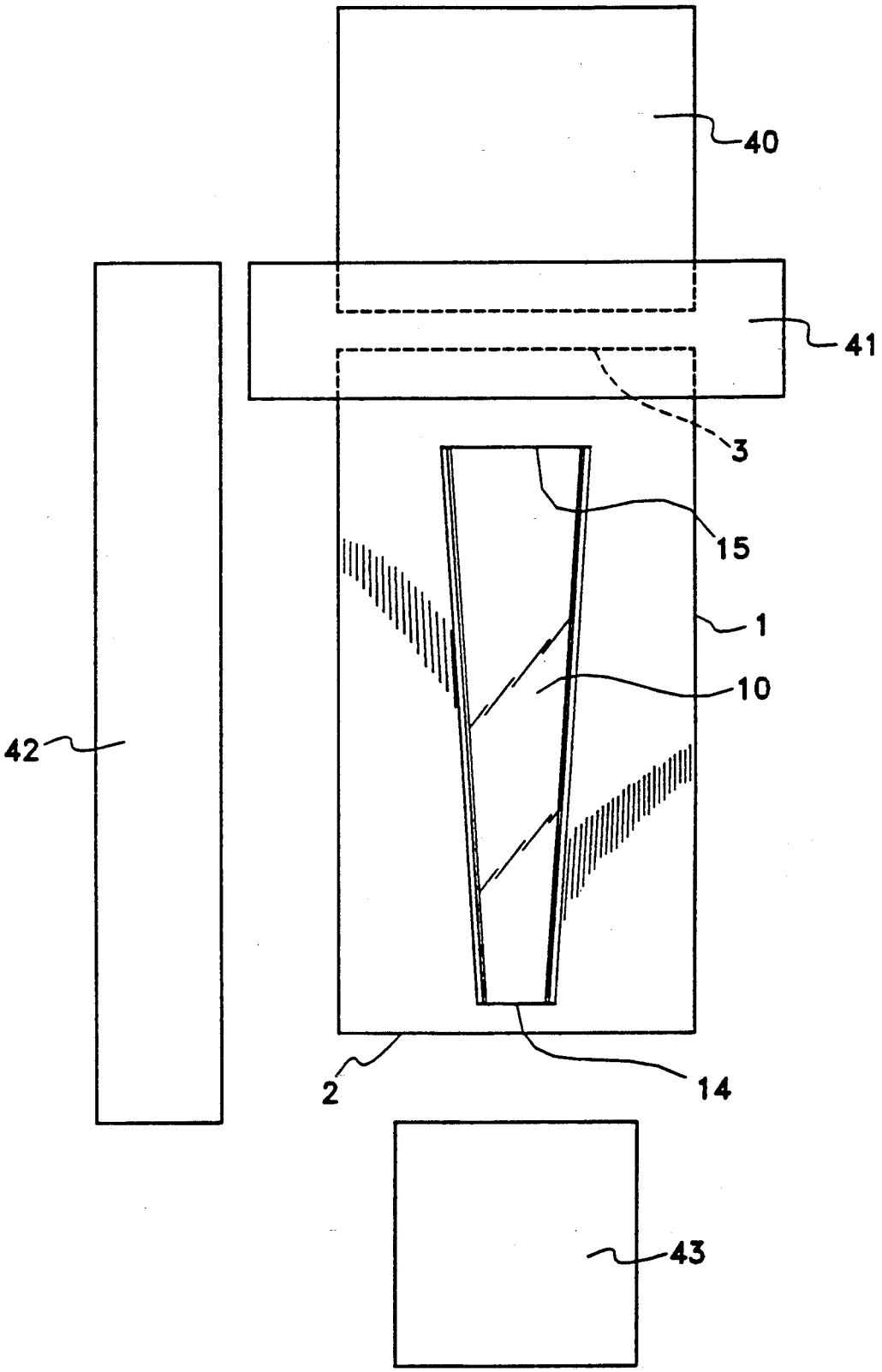

The shape of the second surfaces may vary as well. Although shown in FIGS. 2 and 3 as warped or twisted planes having cross-sections which are approximately linear, the second surfaces may be constructed having cross-sections which are curved, and may be concave or convex. In an alternative embodiment shown in FIGS. 5 and 6, each of the second surfaces 16, 17 are constructed having a first portion 21, 22, immediately adjacent and attached to the top edge of the opposed walls 12, 13, which is substantially not inclined. The inclined portion 23, 24 of the second surfaces extends from this first portion. As described supra, the maximum angle of inclination of the second surfaces 16, 17 adjacent the front end 2 or front edge 14 is selected to cause produce in the closed end of the bags near the front end 2 of the support to form multiple layers. In either embodiment, this angle of inclination $\theta$ preferably decreases gradually toward the rear end 3 of the support to approximately horizontal, minimizing sharp or hard corners and thus facilitating automated dispensing of the produce or articles thereon without damage.

Reduction of bruising and other damage to the produce or articles may also be enhanced by rounding all exposed corners and by cushioning the entire upper surface of the bag support or at least a portion of the second surfaces and trough. Suitable cushioning or padding materials may be readily determined and include, but are not limited to, carpeting, closed-cell foams, and especially Nomad (3-M, St. Paul, Minn.), an open-cell vinyl, extra-duty floor matting.

Flexible and/or cushioned projections may be provided above the support, for gently contacting or jostling the bag filled with produce as it is removed from the support and encourage settling of the produce in the bag. The projections are preferably constructed from an upright support member 31 connected to and extending above the support, and a projecting member 32 extending inwardly over a second surface approximately at an end thereof adjacent the front edge. The projecting member is preferably formed from a flexible or cushioned material including but not limited to a doubled-over strip of carpet or Nomad (supra). Although a plurality of projections may be employed, a single projection having a projecting member extending at least partially over one of the second surfaces is preferred.

In operation, the bag support is employed in combination with produce bagging devices or components thereof conventional in the art. The apparatus may also include, but is not limited to, a produce supply assembly and a bag opening device, and optionally, a bag transfer assembly and a bag closing assembly. Provided adjacent to the rear end 3 of the support, a produce supply assembly such as a conveyor, pan, or hopper receives the produce from a processing station and conveys the same to a bagging station for automatic bagging. The bagging station preferably includes the bag support, a supply of bags held on the bag support as with a wicket and positioned with their open ends facing the rear end 3 of the support, and a bag opening device. The bag support is advantageously inclined with respect to the horizontal with its rear end 3 positioned higher than the front end 2. The bag opening device functions to engage and open a single bag and hold or retain the same in an open position on the support, allowing passage of produce into the bag without collapse. After the bag opening device has engaged and opened a bag on the support, produce is automatically dispensed onto the rear end of the support and into the open end of the bag by the produce supply assembly. The improved bag support of the invention ensures that the produce completely fills the bag and does not form a single layer. After filling a bag, the bag transfer assembly removes and transports the filled bag from the support to a bag closing assembly for applying a closure or otherwise sealing the bag.

The structures of the produce supply assembly, bag opening device, bag transfer assembly, and bag closing assembly are all known in the art, and the skilled practitioner will recognize that any such conventional devices may be employed. Suitable structures of these components include but are not limited to those described, for example, in Powell, Jr. (U.S. Pat. No. 4,177,621) or Sheetz et al. (U.S. Pat. No. 3,864,894), the contents of which are herein incorporated by reference.

It is understood that the foregoing detailed description is given merely by way of illustration and that modifications and variations may be made therein without departing from the spirit and scope of the invention.

We claim:

1. An apparatus for bagging produce or other articles comprising:

a bag support for holding a bag thereon during filling comprising:

a. a trough having a bottom surface and at least two opposed walls extending upwardly from said bottom surface, said bottom surface further having front and rear edges, and each of said opposed walls extend between said front and rear edges, and b. second surfaces extending outwardly from the upper edge of each of said opposed walls, and extending at least between said front and said rear edges, wherein at least a portion of each of said second surfaces is upwardly inclined away from said walls by an angle of inclination relative to horizontal, and further wherein the angle of inclination decreases from a maximum adjacent said front edge to approximately horizontal adjacent said rear edge, said bag being positioned on said support with said closed end adjacent said front edge and said open end facing said rear edge such that a plurality of randomly arrayed articles flows into said bag from said open end to said closed end along said bottom surface, opposed walls and second surfaces to form multiple layers.

2. An apparatus as described in claim 1, wherein said opposed walls are parallel.

3. An apparatus as described in claim 1, wherein the distance between said opposed walls decreases from said rear edge toward said front edge.

4. An apparatus as described in claim 1, wherein the distance between said opposed walls decreases from said front edge toward said rear edge.

5. An apparatus as described in claim 1, wherein each of said second surfaces include a first portion between said opposed walls and said inclined portion, which first portion is not substantially inclined relative to said inclined portion.

6. An apparatus as described in claim 1, wherein said second surfaces extend beyond said rear edge and are joined by a third surface, said third surface extending outwardly from said trough and being integral with said second surfaces.

7. An apparatus as described in claim 1, further comprising at least one support member extending above said second surfaces, and a projecting member connected to said support member and extending inwardly over one of said second surfaces approximately at an end thereof adjacent said front edge.

8. An apparatus as described in claim 7, wherein said projecting member is flexible.

9. An apparatus as described in claim 1, wherein said trough and said second surfaces are cushioned.

10. An apparatus for bagging produce or other articles comprising in combination:

a. a bag support for holding a supply of bags thereon, each said bag having an open end and a closed end, comprising:

1) a trough having a bottom surface and at least two opposed walls extending upwardly from said bottom surface, said bottom surface further having front and rear edges, and each of said opposed walls extend between said front and rear edges, and 2) second surfaces extending outwardly from the upper edge of each of said opposed walls, and extending at least between said front and said rear edges, wherein at least a portion of each of said second surfaces is upwardly inclined away from said walls by an angle of inclination, and further wherein the angle of inclination decreases from a maximum adjacent said front edge to a minimum adjacent said rear edge, said bags being positioned on said support with said closed ends adjacent said front edge and said open ends facing said rear edge such that a plurality of randomly arrayed articles flows into a bag from said open end to said closed end along said bottom surface, opposed walls and second surfaces to form multiple layers;

b. a bag opening device for engaging and opening a single bag on said support; and c. a produce or article supply assembly for dispensing produce or articles onto said support and into the bag.

11. An apparatus as described in claim 10, further comprising a bag closing assembly and a bag transfer assembly for transporting a bag from said bag support to said bag closing assembly.

12. An apparatus as described in claim 10, wherein said opposed walls of said bag support are parallel.

13. An apparatus as described in claim 10, wherein the distance between said opposed walls of said bag support decreases from said rear edge toward said front edge.

14. An apparatus as described in claim 10, wherein the distance between said opposed walls of said bag support decreases from said front edge toward said rear edge.

15. An apparatus as described in claim 10, wherein each of said second surfaces of said bag support include a first portion between said opposed walls and said inclined portion, which first portion is not substantially inclined relative to said inclined portion.

16. An apparatus as described in claim 10, wherein said second surfaces of said bag support extend beyond said rear edge and are joined by a third surface, said third surface extending outwardly from said trough and being integral with said second surfaces.

17. An apparatus as described in claim 10, further comprising at least one support member extending above said second surfaces of said bag support, and a projecting member connected to said support member and extending inwardly over one of said second surfaces approximately at an end thereof adjacent said front edge.

18. An apparatus as described in claim 17, wherein said projecting member is flexible.

19. An apparatus as described in claim 10, wherein said trough and said second surfaces of said bag support are cushioned.

20. A method for bagging produce or other articles comprising:

a. providing a bag having an open end and a closed end on a bag support comprising:

1) a trough having a bottom surface and at least two opposed walls extending upwardly from said bottom surface, said bottom surface further having front and rear edges, and each of said opposed walls extend between said front and rear edges, and 2) second surfaces extending outwardly from the upper edge of each of said opposed walls, and extending at least between said front and said rear edges, wherein at least a portion of each of said second surfaces is upwardly inclined away from said walls by an angle of inclination, and further wherein the angle of inclination decreases from a maximum adjacent said front edge to a minimum adjacent said rear edge, said bag being positioned with said closed end adjacent said front edge and said open end facing said rear edge;

b. dispensing produce or articles onto said bag support such that said produce or articles flow into said bag through said open end to said closed end, and c. guiding said produce or articles along said bottom surface, opposed walls, and second surfaces toward said front edge to form multiple layers.

21. An apparatus as described in claim 1, wherein the distance between said upper edge of said opposed walls decreases from said rear edge toward said front edge.

22. An apparatus as described in claim 1, wherein the distance between said upper edge of said opposed walls decreases from said front edge toward said rear edge.

23. An apparatus as described in claim 3, wherein said apparatus is symmetric about a vertical plane extending through the center of said trough from said front edge to said rear edge.

24. An apparatus as described in claim 4, wherein said apparatus is symmetric about a vertical plane extending through the center of said trough from said front edge to said rear edge.

* * * * *